United States Patent [19]

van de Wetering

[11] Patent Number: 4,898,289

[45] Date of Patent: Feb. 6, 1990

[54] METHOD OF HANDLING A LOAD WITH A CRANE VESSEL HAVING MOVABLE LOAD SUPPORTS

[75] Inventor: Wietse J. van de Wetering, The Hague, Netherlands

[73] Assignee: Heerema Engineering Service BV, Leiden, Netherlands

[21] Appl. No.: 229,315

[22] Filed: Aug. 8, 1988

[30] Foreign Application Priority Data

Aug. 7, 1987 [GB] United Kingdom ..... 8718768

[51] Int. Cl.[4] ..... B66C 23/52; B63B 27/00

[52] U.S. Cl. ..... 212/270; 212/190; 212/234; 114/268; 114/264; 414/786; 414/542; 414/141.7

[58] Field of Search ..... 212/190–194, 212/200, 211, 224, 234, 270; 114/27–29, 31–32, 259–260, 264–266, 268; 414/469, 498, 522, 542–543, 539, 786, 137–139

[56] References Cited

U.S. PATENT DOCUMENTS

| | | | |
|---|---|---|---|
| 2,776,761 | 1/1957 | Lovelace | 414/542 |
| 3,971,309 | 7/1976 | Brodie | 414/680 |
| 4,266,680 | 5/1981 | Velikoselsky et al. | 212/234 |
| 4,599,027 | 7/1986 | Knapp | 212/234 |

FOREIGN PATENT DOCUMENTS

| | | | |
|---|---|---|---|
| 2023074 | 12/1979 | United Kingdom | 212/190 |

*Primary Examiner*—Joseph F. Peters, Jr.
*Assistant Examiner*—R. B. Johnson
*Attorney, Agent, or Firm*—Fulwider, Patton, Rieber, Lee & Utecht

[57] ABSTRACT

A crane vessel (20) has a temporary load support structure (23) on which to support a load (22) in transit. For installation, the load is hooked up to the vessel crane (21) and the temporary support structure is removed to enable the vessel to set down the load on its tower structure (24).

1 Claim, 8 Drawing Sheets

FIG. 5.
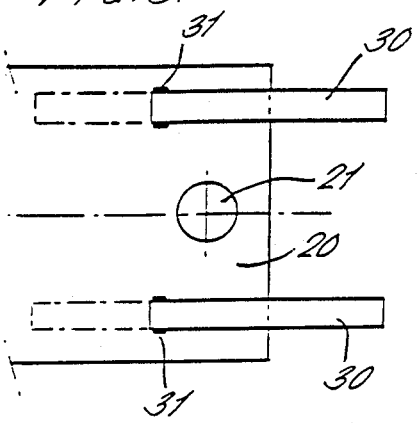
FIG. 6.
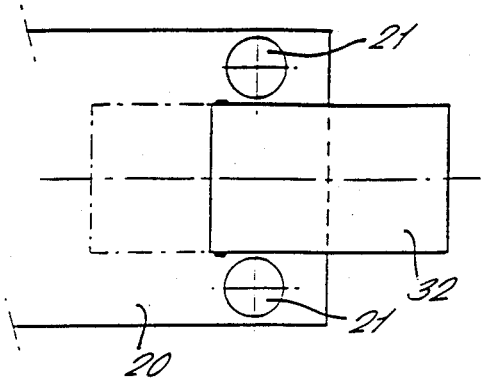
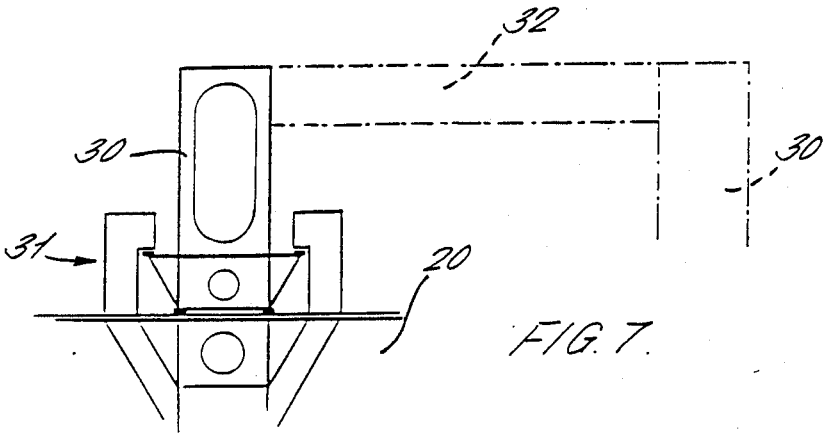
FIG. 7.
FIG. 8.
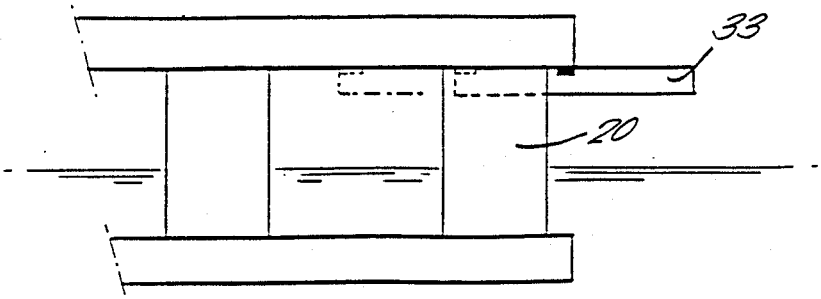

METHOD OF HANDLING A LOAD WITH A CRANE VESSEL HAVING MOVABLE LOAD SUPPORTS

This invention relates to a crane vessel.

BACKGROUND TO THE INVENTION

Where possible, crane vessels are used to carry their load to an offshore site. The crane is used to lift the load off the deck of the vessel and slew it round to the required position for installation. In some cases, this procedure is not possible, for example, if slewing over the side is restricted by lack of stabilization or if the load is so heavy that it has to be handled by two or more cranes. Heavy lift offshore cranes are commonly able to handle far heavier loads if used in a fixed working position than when they are used in slewing mode. In a fixed working position, the crane can be provided with additional strengthening, eg, a back stay between the boom tip and the deck, to further increase its lifting capacity. In such cases, however, it is necessary to have a cargo barge from which to pick up the load. This conventional procedure is illustrated in FIGS. 1A to 1C of the accompanying drawings. The procedure has the disadvantage of requiring a separate barge, and workability is restricted because of relative movements between the cargo barge and crane vessel.

BRIEF SUMMARY OF THE INVENTION

The present invention provides a crane vessel of the kind having at least one heavy lift crane operable in a working position to lift and lower loads clear of the vessel over a side or an end of the vessel, comprising support means for providing support for a load, and means for positioning the support means on the vessel in a load carrying position in which the support means is supported vertically at least partly by the vessel and the support means extends outboard of the vessel at said side or end thereof enabling a load to be lowered onto or lifted from the support means by the crane in its working position, the support means being removable from its load carrying position to allow clearance for operation of the crane in its working position.

The invention also provides a method of using a crane vessel of the kind having at least one heavy lift crane operable in a working position to lift and lower loads clear of the vessel over a side or an end of the vessel, comprising the steps of picking up a load using the crane in its working position, positioning support means on the vessel in a load carrying position in which the support means is directly beneath the crane in its working position and is supported vertically at least partly by the vessel, lowering a load onto the support means, transporting the vessel to an installation site with the load on the support means, picking up the load form the support means at the installation site, removing the support means from its load carrying position, positioning the vessel and installing the load using the crane in its working position.

By way of example, some embodiments of the invention will now be described with reference to the accompanying drawings, in which:

BRIEF DESCRIPTION OF THE DRAWINGS

FIGS. 3 to 12 illustrate vessels with various alternative forms of temporary load support structure.

DESCRIPTION OF THE PREFERRED EMBODIMENT

Figure 1A:
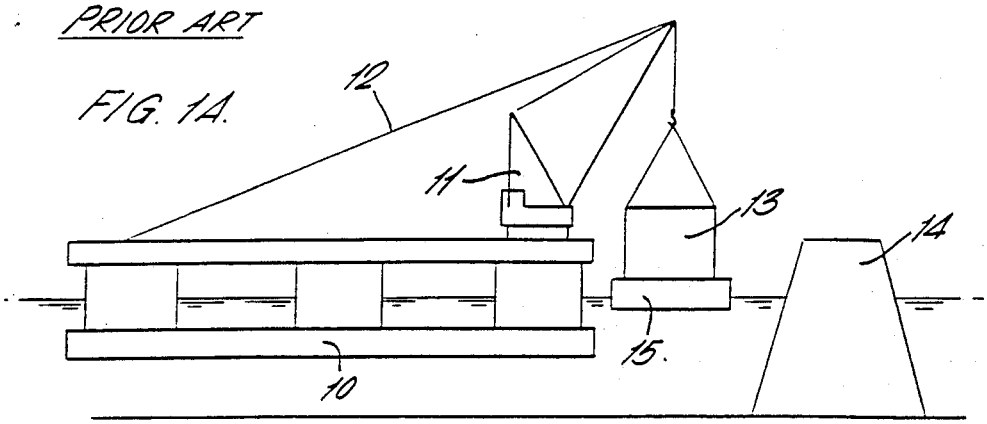
PRIOR ART FIG. 1A.
FIGS. 1A, 1B and 1C illustrate steps in a typical procedure using a conventional crane vessel.
Figure 1B:
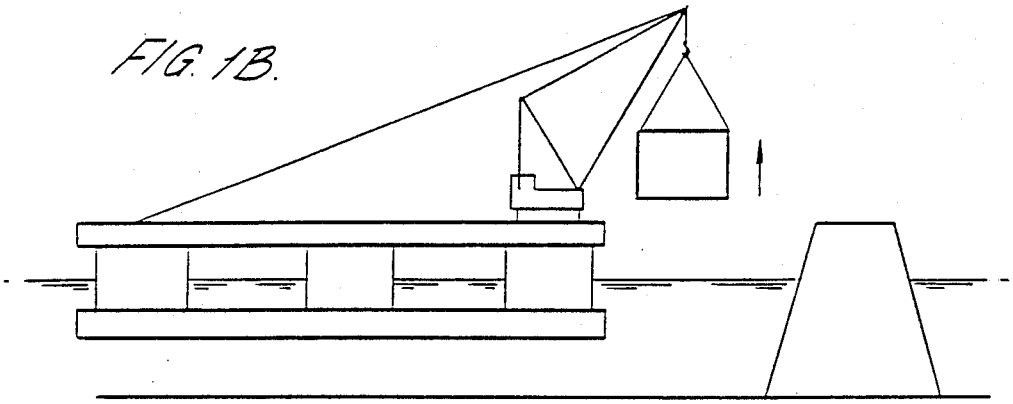
Figure 1C:
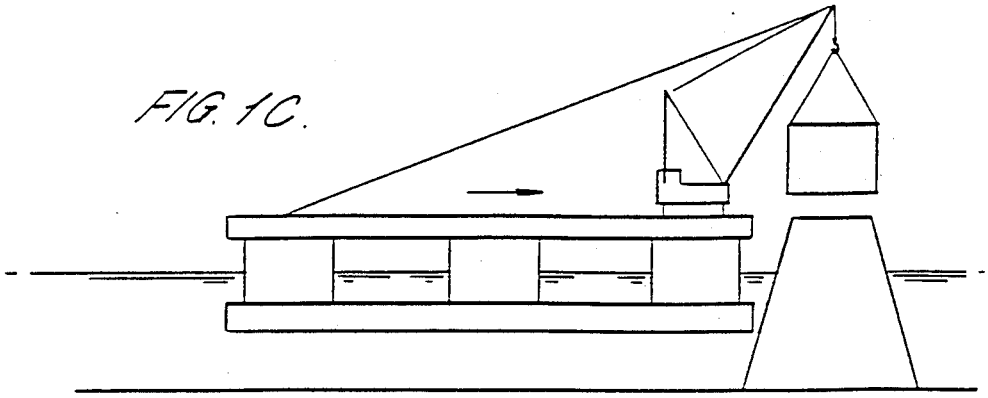

There is seen in FIG. 1 a crane vessel 10 having a heavy lift crane 11 deployed in a fixed working position. The crane 11 is strengthened by a back stay 12. The vessel 10 is to install a heavy load 13, eg a deck module, on a tower structure 14, eg a platform jacket, at an offshore site. A cargo barge 15 is used to carry the load 13 to the site. The load 13 is lifted by the crane 11 off the barge 15 (FIG. 1A). The barge is removed (FIG. 1B), leaving room for the vessel to be brought up into position relative to the tower structure for setting down of the load (FIG. 1C). This is conventional procedure.

Figure 2A:
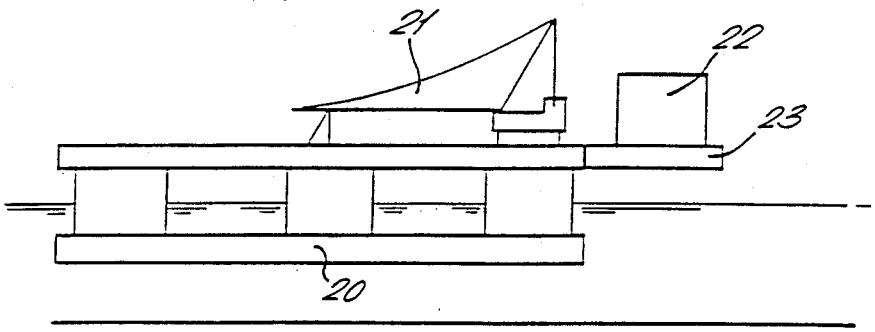
FIGS. 2A, 2B and 2C illustrate steps in use of a crane vessel according to the present invention.
Figure 2B:
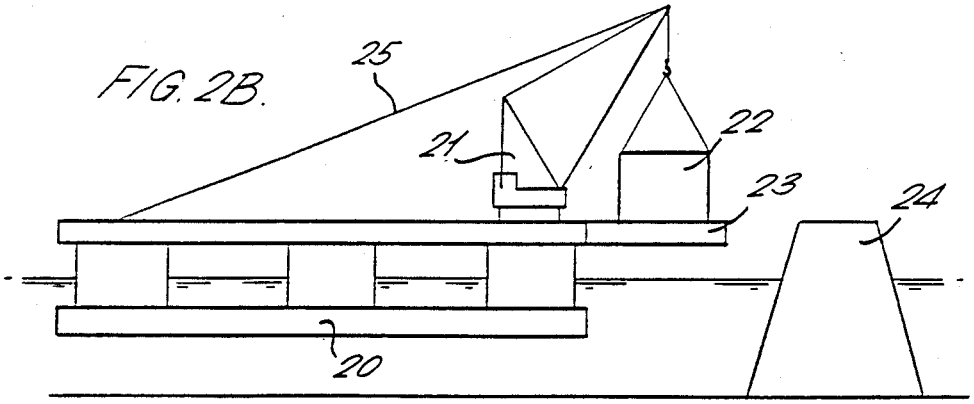
Figure 2C:
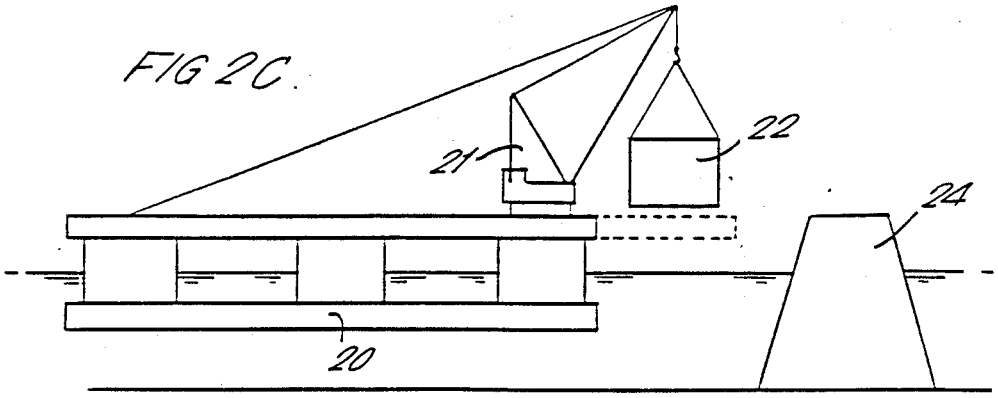

There is seen in FIGS. 2A, 2B and 2C use of a crane vessel 20 according to the present invention. The vessel 20 is seen in FIG. 2A loaded in transit, ie with its crane 21 stowed away on deck and load 22 supported by a temporary load support structure 23. When the vessel 20 reaches the site of the tower structure 24, the crane 21 is rigged up, possibly with additional back stays 25 (FIGS. 2B). With the crane 21 in its fixed working position, the load 22 is lifted off the temporary support structure 23, and the temporary support structure is removed (FIG. 2C). The way is now clear for the vessel 20 to be brought up into position relative to the tower structure 24 for setting down of the load 22. It will be appreciated that loading of the load 22 onto the vessel 20 using crane 21 and temporary support structure 23 will require similar steps to the unloading procedure described above, but in reverse order. The advantage of the procedure according to the present invention is tht no separate barge is needed to carry the load to the site and therefore the problems of transferring the load from the barge to the crane vessel offshore do not arise.

In practice, the vessel 20 will often have two or more such cranes 21 rigged up to work side by side. The temporary support structure 23 is preferably connected to the vessel 20 in such a way as to enable it to be moved between its load carrying position (as seen in FIG. 2A) and a stowed position. In its stowed position, the support 23 is cleared away from the area of operation of the crane 21, ie the area directly below the crane boom tip. The temporary load support structure may take many different forms and examples of these are illustrated in the following figures of the drawings.

Figure 3:
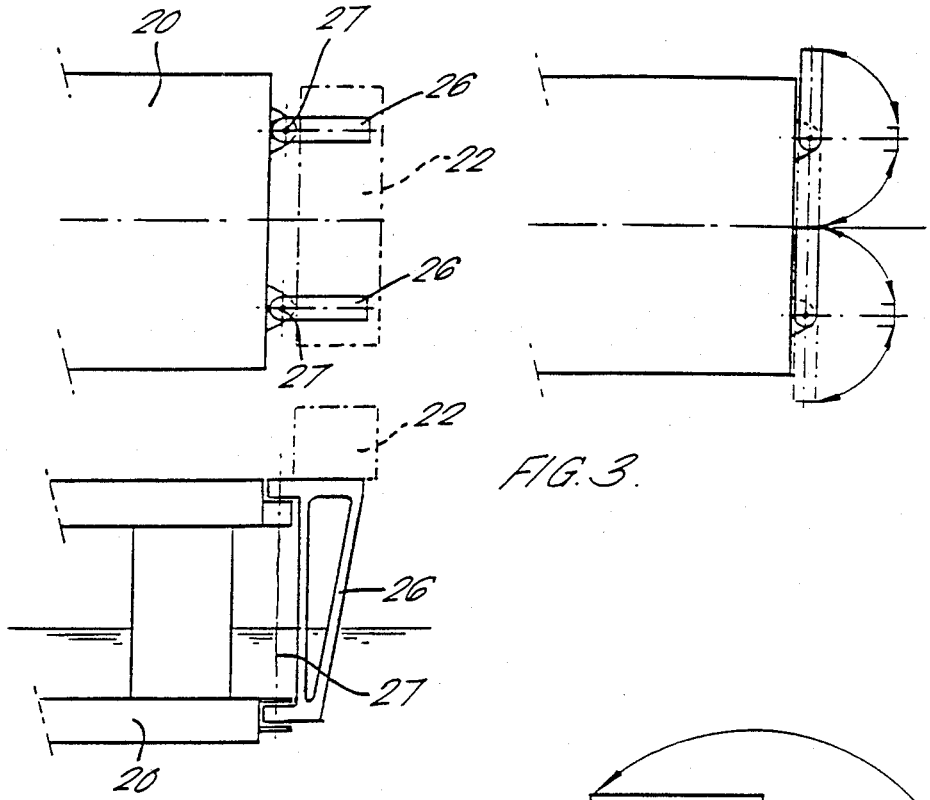

In FIGS. 3, the temporary support structure for the load 22 takes the form of outriggers 26 which are hingedly mounted on the vessel 20 to pivot about vertical axes 27 between a load carrying position and a stowed position.

Figure 4:
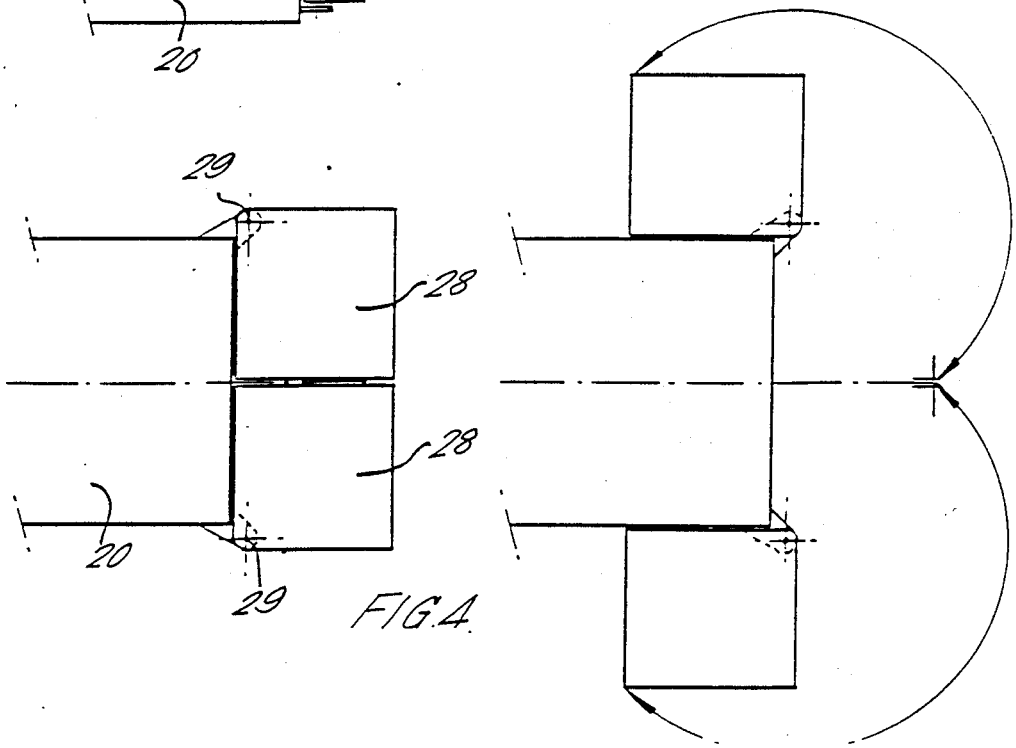

In FIG. 4, additional stern sections 28 are provided which are hingedly mounted on the vessel 20 to pivot about vertical axes 29 between a load carrying position and a stowed position. The stern sections 28 may be provided with a hull and add buoyancy to the vessel 20.

In FIG. 5, skidding beams 30 are arranged on the deck of the vessel 20 on either side of the crane 21. The skidding beams 30 can be extended outboard of the vessel or retracted, and are arranged to cooperate with guiding and clamping devices 31 on the deck of the vessel 20. In FIG. 6 a similar arrangement is used, except that here, a deck structure 32 is formed between skidding beams and the deck structure is arranged between two cranes 21 on the deck of the vessel 20. FIG. 7 illustrates a possible arrangement of the guiding and clamping device 31 for a skidding beam 30 or deck structure 32.

FIG. 8 shows the possibility of positioning the skidding beam or deck structure 33 below the deck of the vessel 20.

Figure 9:
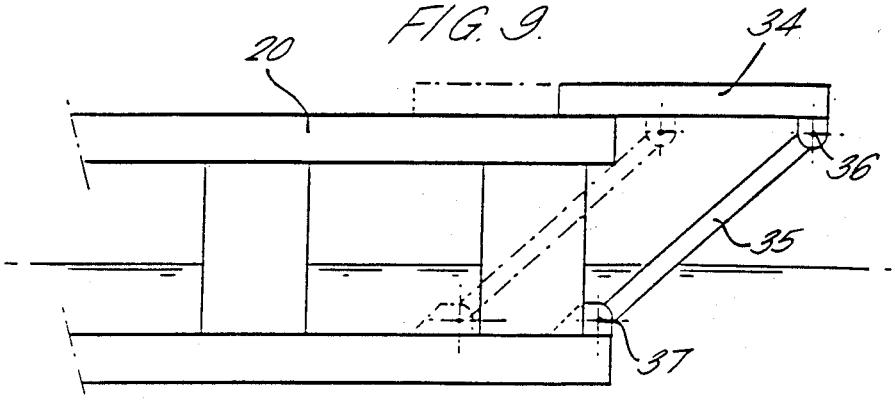
Figure 10:
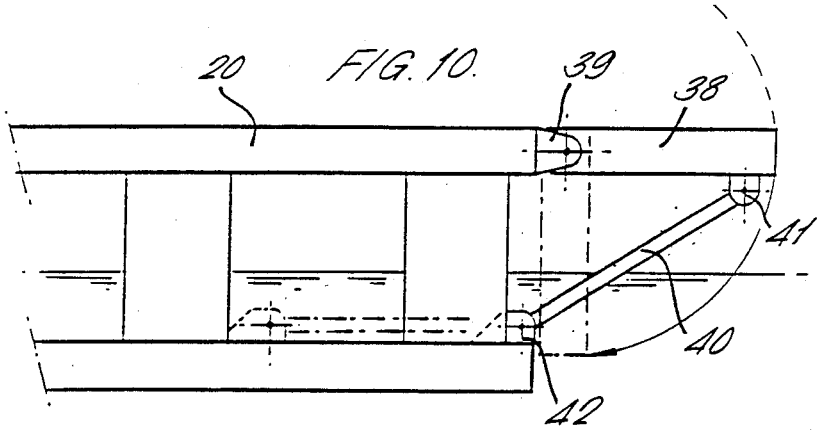

FIGS. 9 and 10 show the possibility of providing a bracing strut assembly to provide additional support for the temporary support structure. In FIG. 9, the temporary support structure is in the form of skidding beams or a sliding deck structure 34. The bracing strut assembly 35 is pivotably mounted to the skidding beams or sliding deck structure 34 by a hinge 36 and pivotably mounted to the vessel 20 by a hinge 37. The hinge 37 is preferably slidable, eg, by being skid mounted on the vessel 20, which enables the whole structure to be withdrawn inboard without disconnection of the strut assembly 35. This alternative is particularly favourable if the skidding beams or sliding deck structure 34 is mounted below the deck of the vessel 20. In FIG. 10, the temporary support structure is in the form of a deck structure or beams 38 which are pivotably mounted on the vessel 20 by a hinge 39. The bracing strut assembly 40 is pivotably connected to the deck structure or beams 38 by a hinge 41 and pivotably mounted to the vessel 20 by a slidable, eg, skid mounted hinge 42 allowing fast removal of the deck strucutre or beams 38.

Figure 11A:
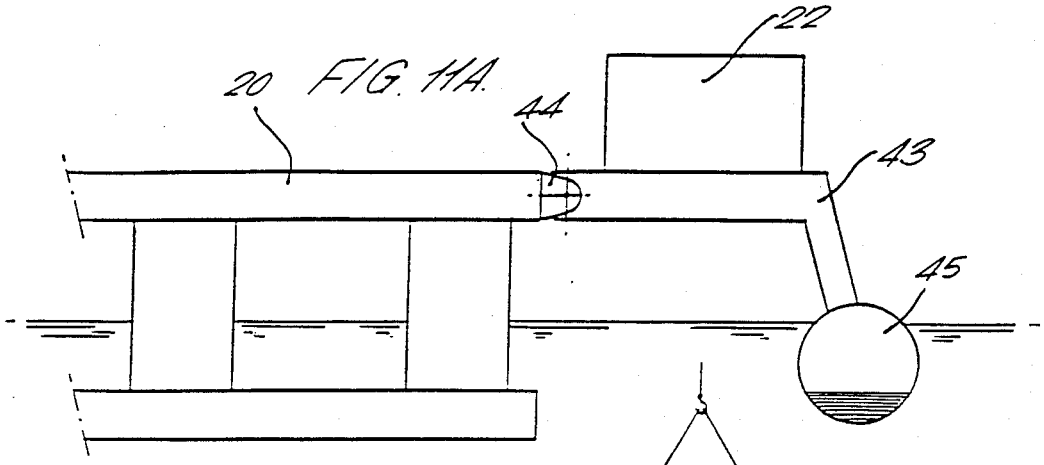
Figure 11B:
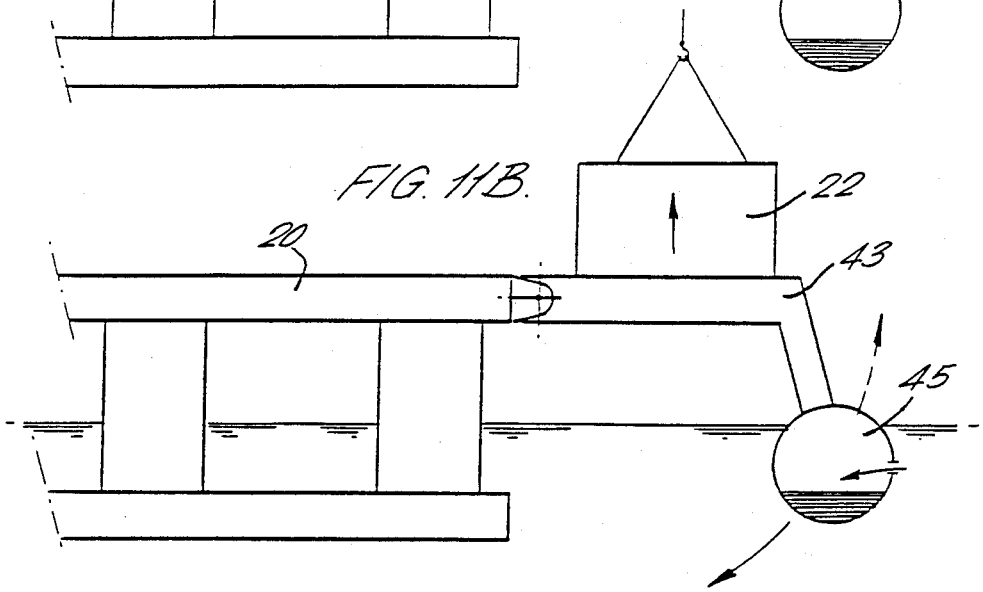
Figure 11C:
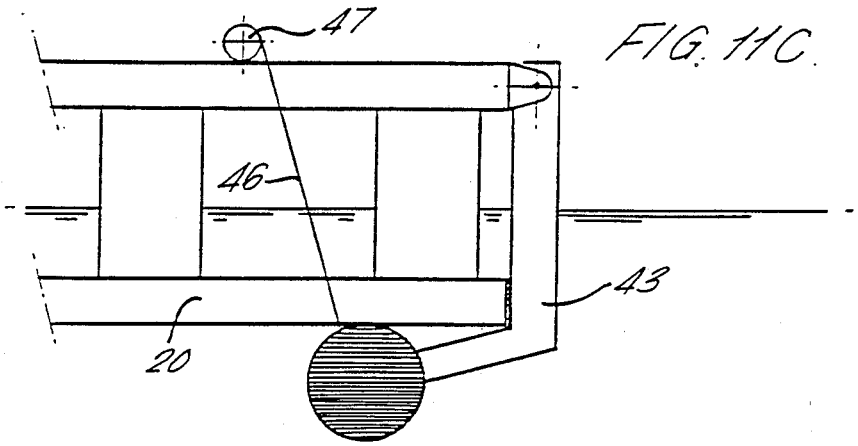

In FIGS. 11A, 11B and 11C there is seen a temporary support structure for load 22 which is in the form of an articulated deck 43 connected to the vessel 20 by means of a hinge 44 and supported by buoyant body 45. The vessel 20 is seen in FIG. 11A loaded in transit. The buoyant body 45 can be ballasted and deballasted to suit the load 22. The articulated deck 42 is withdrawn to its stowed position after the load 22 has been hooked up to the crane (FIG. 11B). The articulated deck 43 is withdrawn by ballasting the buoyant body 45. Withdrawal of the articulated deck 43 can be aided by a tether 46, eg wire or chain connected to a winch 47, which is also used to secure the articulated deck in its stowed position to the vessel 20.

Figure 12A:
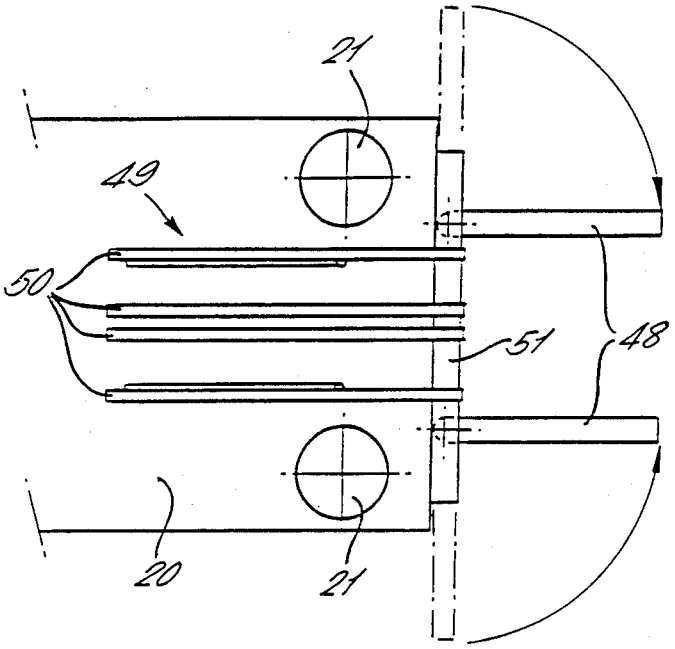
Figure 12B:
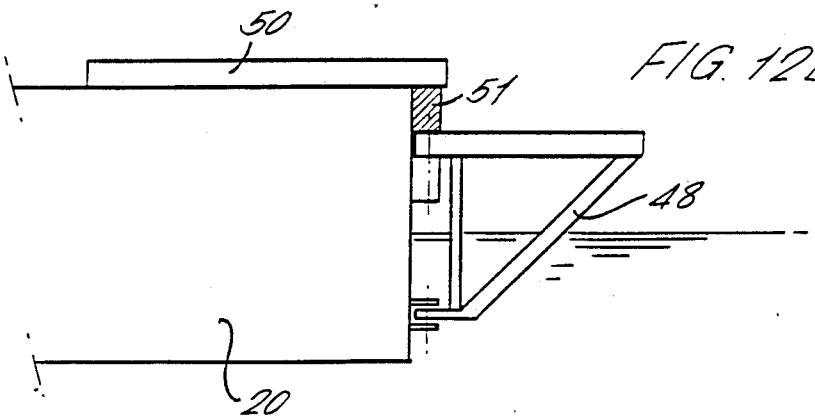
Figure 12C:
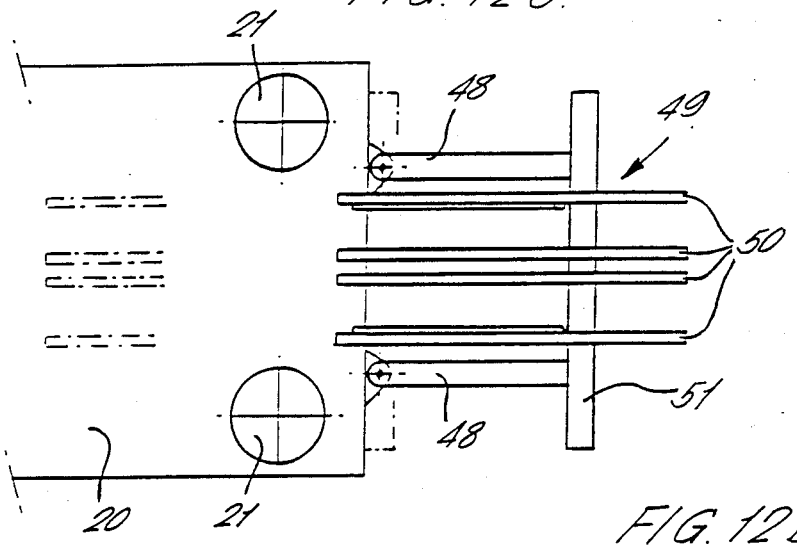
Figure 12D:
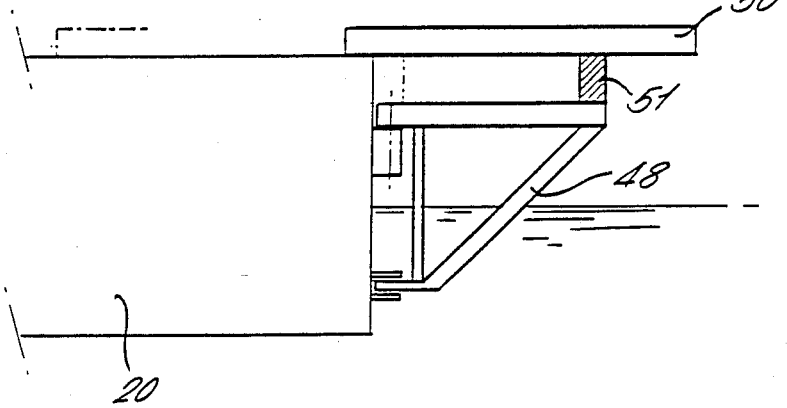
Figure 12E:
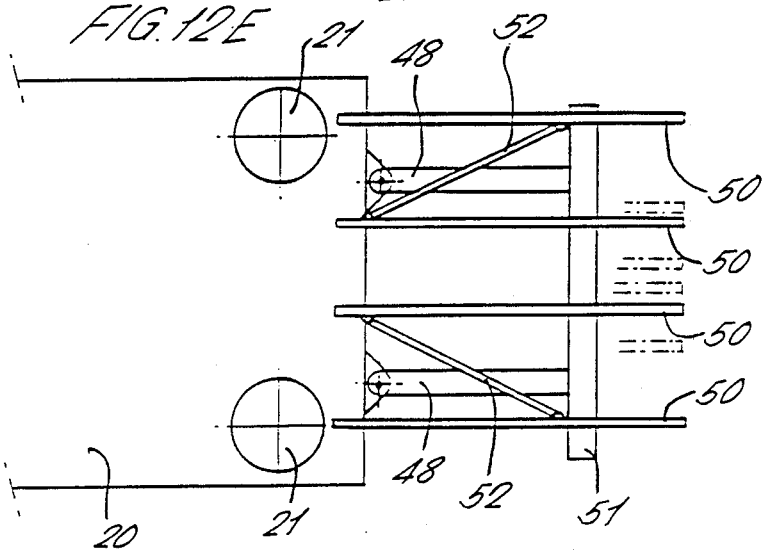

There is seen in FIGS. 12A to 12E a temporary load support structure which combines the ideas of FIGS. 3 and 5. Cantilever structures 48 are swung from their stowed position to a load carrying position (FIGS. 12A, 12B). Movable deck structure 49 comprising longitudinal beams 50 and transverse beam 51 is situated between cranes 21 on the deck of the vessel 20. The movable deck structure 49 is skidded outboard of the deck of the vessel 20 until transverse beam 51 is at the distal ends of the cantilever structures 48 (FIGS. 12C, 12D). The longitudinal beams 50 can now be spread to a load carrying condition between transverse beam 51 and the deck of the vessel 20 (FIG. 12E). Braces 52 can be connected between the longitudinal beams 50 for spacing and stabilizing purposes.

What is claimed is:

1. A method of using a crane vessel of the kind having at least one heavy lift crane operable in a working position to lift and lower loads clear of the vessel over a side or an end of the vessel, comprising the steps of picking up a load using the crane in its working position, positioning support means on the vessel in a load carrying position in which the support means is directly beneath the crane in its working position and is supported vertically at least partly by the vessel, lowering a load onto the support means, transporting the vessel to an installation site with the load on the support means, picking up the load from the support means at the installation site, removing the support means from its load carrying position, positioning the vessel adjacent the installation site and depositing the load at the installation site the load using the crane in its working position.

* * * * *

UNITED STATES PATENT AND TRADEMARK OFFICE

CERTIFICATE OF CORRECTION

PATENT NO. : 4,898,289

DATED : February 6, 1990

INVENTOR(S) : Wietse, J. van de Wetering

It is certified that error appears in the above-identified patent and that said Letters Patent is hereby corrected as shown below:

Column 4, lines 36 and 37, after "site" and before "using" delete [the load].

Signed and Sealed this

Fifteenth Day of September, 1992

*Attest:*

DOUGLAS B. COMER

*Attesting Officer*

*Acting Commissioner of Patents and Trademarks*